US009995141B2

(12) United States Patent
Ficht et al.

(10) Patent No.: US 9,995,141 B2
(45) Date of Patent: Jun. 12, 2018

(54) SLIDING BLOCK FOR A SCOTCH YOKE RECIPROCATING PISTON ENGINE

(71) Applicant: Bertwin Geist, Eurasburg (DE)

(72) Inventors: Reinhold Ficht, Kirchseeon (DE); Tobias Steinbeißer, München (DE)

(73) Assignee: Bertwin R. Geist, Eurasburg (DE)

( * ) Notice: Subject to any disclaimer, the term of this patent is extended or adjusted under 35 U.S.C. 154(b) by 24 days.

(21) Appl. No.: 14/898,191

(22) PCT Filed: May 8, 2014

(86) PCT No.: PCT/EP2014/059474
§ 371 (c)(1),
(2) Date: Dec. 14, 2015

(87) PCT Pub. No.: WO2014/206621
PCT Pub. Date: Dec. 31, 2014

(65) Prior Publication Data

US 2016/0130945 A1 May 12, 2016

(30) Foreign Application Priority Data

Jun. 27, 2013 (DE) ..... 10 2013 106 755

(51) Int. Cl.
*F02B 75/32* (2006.01)
*F01B 9/02* (2006.01)
*F02B 75/24* (2006.01)

(52) U.S. Cl.
CPC ..... *F01B 9/023* (2013.01); *F01B 9/026* (2013.01); *F02B 75/24* (2013.01)

(58) Field of Classification Search
CPC ..... F01B 9/023; Y10T 74/18256; F01M 1/06; F01M 11/02; F01M 2011/026
USPC ..... 123/197.4, 193.6; 184/6.5
See application file for complete search history.

(56) References Cited

U.S. PATENT DOCUMENTS 4,013,048 A * 3/1977 Reitz ..... F01B 9/023 123/197.2
4,491,097 A 1/1985 Hamann
4,884,536 A * 12/1989 Neale ..... F01B 9/023 123/197.4

(Continued)

FOREIGN PATENT DOCUMENTS

CN 87102539 A 11/1987
CN 1110371 A 10/1995

(Continued)

*Primary Examiner* — Marguerite McMahon
*Assistant Examiner* — James Kim

(57) ABSTRACT

A sliding block for a scotch yoke reciprocating piston engine having a base body with a receiving opening for cooperating with a crankpin of a crankshaft and side surfaces, which are oriented toward slide ways of a scotch yoke during operation, with a supply of pressurized lubricant from the receiving opening for the crankpin to the side surfaces being provided during operation, characterized in that the base body is provided with sliding plates in the region of the side surfaces oriented toward the slide ways of the scotch yoke, characterized in that the sliding plates are supported in floating fashion relative to the base body and between the sliding plates and the side surfaces, there is a gap, which is at least partially filled with lubricant during operation of the scotch yoke reciprocating piston engine.

17 Claims, 4 Drawing Sheets

(56) References Cited

U.S. PATENT DOCUMENTS

| | | | | | |
|---|---|---|---|---|---|
| 5,131,353 | A * | 7/1992 | Bauer | F01B 9/023 | 123/197.4 |
| 5,327,863 | A * | 7/1994 | Downton | F01B 9/023 | 123/197.4 |
| 5,493,952 | A * | 2/1996 | Daniel | F01B 1/08 | 123/196 R |
| 2006/0083451 | A1 * | 4/2006 | Kawagoe | F16C 33/201 | 384/276 |

FOREIGN PATENT DOCUMENTS

| | | | |
|---|---|---|---|
| CN | 101059151 | A | 10/2007 |
| CN | 101765699 | A | 6/2010 |
| DE | 3218339 | A1 | 11/1983 |
| DE | 3442608 | A1 | 5/1986 |
| DE | 8913971 | U1 | 3/1991 |
| DE | 4035562 | A1 | 5/1992 |
| DE | 4042425 | A1 | 6/1992 |
| DE | 19915219 | A1 | 11/2000 |
| JP | H10274155 | A | 10/1998 |
| JP | 2004293320 | A | 10/2004 |
| WO | 0227143 | A1 | 4/2002 |

* cited by examiner

SLIDING BLOCK FOR A SCOTCH YOKE RECIPROCATING PISTON ENGINE

FIELD OF THE INVENTION

The invention relates to a sliding block for a scotch yoke reciprocating piston engine.

BACKGROUND OF THE INVENTION

U.S. Pat. No. 4,013,048 has disclosed a scotch yoke engine with a sliding block that is supported in sliding fashion in a scotch yoke. The sliding block has sliding sides that cooperate with a slide way of the scotch yoke. The sliding sides have a groove-like conduit structure, and conduits conveying pressurized oil are provided to fill the grooves with oil.

JP 2004 293320A has disclosed a multi-cylinder compressor in a scotch yoke design. In this compressor, which is in particular distinguished by a very short stroke, slide ways are supported in resilient fashion in the scotch yoke. The oil for the yoke slide ways/sliding block sliding pair is supplied via the scotch yoke. Such an oil supply for this sliding pair is cumbersome and is unsuitable, at least for reciprocating piston engines with a scotch yoke design that are operated as internal combustion engines. In addition, such a pressurized oil supply, as disclosed in JP 2004 293320A, is unsuitable for reciprocating piston engines with a longer stroke.

WO02/27143A1 has disclosed a sliding block for a reciprocating piston engine designed in the form of a scotch yoke engine in which pressurized oil conduits supply the sliding pair between the sliding block and the slide way of the scotch yoke with pressurized oil from the sliding block. A sliding block of this generic type has proven its value, but dynamic tilting processes of the sliding block inside the scotch yoke—particularly during operation over long periods of time—still cause undesirable wear and tear to occur on the sliding side of the sliding block and/or the slide way of the scotch yoke.

DE 3218339A1 has disclosed a scotch yoke assembly for an internal combustion engine in which slide ways of a scotch yoke are composed of separately inserted sliding plates.

The object of the invention is to disclose a sliding block for a scotch yoke reciprocating piston engine in which the wear and tear are further minimized in a sliding pair between the sliding block and a slide way of the scotch yoke. Another object of the invention is to disclose a sliding block, which is to the greatest extent possible able to compensate for the tolerances that occur in the parallelism of slide ways of the scotch yoke, without increasing the wear.

These objects are entirely attained with a sliding block that has the features described below.

SUMMARY OF THE INVENTION

The invention is based on the recognition that in order to attain the technical object, it is advisable to associate the sliding block with sliding plates that are supported in floating fashion relative to it so that on the one hand, a lubricant cushion is produced between the base body of the sliding block and the sliding plates and on the other hand, a lubricant film is produced between the sliding plates and the slide way of the scotch yoke. For the first time, therefore, the invention takes the approach of providing a double lubricant film or double lubricant cushion between the base body of the sliding block and the scotch yoke through the interposition of as sliding plate. In this case, the one lubricant cushion that forms between the sliding plate and the slide way of the scotch yoke, due to the oscillating movement of the sliding plate relative to the slide way of the scotch yoke, is a dynamically forming lubricant film. The lubricant cushion that forms between the sliding plate and the base body of the sliding block in this case is a lubricant cushion that forms due to the static lubricant pressure of a lubricant pump of the scotch yoke reciprocating piston engine. The sliding plate is fixed relative to the base body of the sliding block in a sliding direction and consequently moves along with the base body of the sliding block. Perpendicular to a sliding direction, in particular perpendicular to the slide way of the associated scotch yoke or perpendicular to a sliding side of the sliding plate that is oriented toward the slide way of the scotch yoke, the sliding plate is supported in floating fashion relative to the base body of the sliding block. On the one hand, these measures according to the invention make it possible to minimize the wear between the sliding plate and the slide way of the scotch yoke. On the other hand, like a hydraulic play compensation that the lubricant cushion produces between the sliding plate and the base body of the sliding block, it is possible to achieve an effective tolerance compensation of possibly existing tolerances between opposing slide ways of a scotch yoke. By means of this embedding of the sliding plates in two different lubricant films or lubricant cushions in the manner according to the invention, i.e. by means of embedding them in a static lubricant cushion between the base body and the sliding plate and a dynamic lubricant film between the sliding plate and the scotch yoke, it is possible—even with the inevitably occurring tilting movements of the sliding block relative to the scotch yoke—to minimize wear, particularly at the edges of the end regions of the sliding plate (viewed in the sliding direction).

Possible lubricants particularly include oils or, for example with lubricated parts that are made of ceramic materials, also water or water/oil emulsions. In addition, solid lubricants such as $MoS_2$ can be used, preferably together with a fluid. Depending on the material properties of the partners that are to be lubricated, it is possible to use any suitable type of fluid.

According to a particular embodiment of the invention, encompassing the gap between the sliding plate and the base body of the sliding block at least partially at the edges, a barrier is provided to prevent the escape of lubricant from the gap. This makes it possible to selectively influence the escape of the lubricant from the static lubricant cushion between the sliding plate and the base body of the sliding block. In particular, this is essential for reliably preventing an uncontrolled drop in lubricant pressure from occurring in the entire scotch yoke reciprocating piston engine.

For example, the barrier can be at least one partition wall that extends away from the at least one sliding plate, covering the gap. Or it can be a partition wall that extends away from the base body of the sliding block, covering the gap. The barrier can be present around the entire circumference, consequently functioning like a labyrinth seal for lubricant possibly escaping from the static lubricant cushion, thus effectively preventing the escape of lubricant and ensuring the presence of a sufficient lubricant cushion between the base body of the sliding block and the sliding plate.

In a preferred way, the barrier is also used to secure the at least one slide way in a form-fitting fashion in a sliding direction relative to the base body.

If the sliding plate is secured relative to the base body of the sliding block by means of partition walls, it is then possible to support the sliding plate in floating fashion relative to the base body in a direction perpendicular to a plane of the sliding plate of the scotch yoke, thus ensuring both that a static lubricant cushion can form between the base body and the sliding plate and that a dynamic lubricant cushion (lubricant film) can form between the sliding plate and the corresponding slide way of a scotch yoke.

In order to insure the lubricant supply to the gap between the sliding plate and the base body, the base body has at least one conduit, which conveys pressurized lubricant during operation, and thus communicates with the gap.

In order for the lubricant, which has been supplied to the gap via the conduit, to be conveyed onward, the sliding plate can advantageously have at least one lubricant conducting opening, through which lubricant can be conveyed in a second gap between the slide way of the scotch yoke and the sliding plate during operation. By means of a central lubricant supply of the sliding block, it is thus possible for both the lubricant cushion between the sliding plate and the base body of the sliding block and the lubricant film between the sliding plate and the slide way of the scotch yoke to be supplied with sufficient lubricant via the crankpin of a crankshaft, in this case, it is possible, for example, for a lubricant conducting opening to be aligned with the conduit so that lubricant can travel directly from the conduit through the lubricant conducting opening, and into the second gap between the sliding plate and the slide way of the scotch yoke. In addition to the above-mentioned conduit that is aligned with the lubricant conducting opening, other conduits can be provided in the base body of the sliding block, which supply lubricant into the first gap between the base body of the sliding block and the sliding plate in order to produce the static lubricant cushion.

In order to supply a sufficient quantity of lubricant in the dynamic lubricant film between the sliding plate and the slide way of the scotch yoke to improve the emergency operation properties, it is advantageous to provide a plurality of recesses in a sliding side of the sliding plate that is oriented toward the scotch yoke during operation in order to provide lubricant pockets.

The recesses can, for example, be embodied in the form of spherical cups or round depressions and have a depth of approximately 0.05 to 0.1 mm. It is advantageous to select the flat portion of the recesses to be no greater than 50%, preferably 20%-40%, of the base area of the sliding side.

It has turned out to be advantageous to arrange the recesses in a linear fashion in a longitudinal direction of the sliding plate. The emergency operation properties can also be particularly improved in that the lines composed of the recesses enclose an angle $\alpha$ relative to the sliding direction, where the angle $\alpha$ is advantageously between 3° and 20°, in particular between 5° and 15°.

As with providing recesses, it has proven useful to provide the sliding side of the sliding plate with a plurality of nub-like projections, which are arranged in a linear fashion in a longitudinal direction of the sliding plate. In addition, the lines that are formed by the projections can enclose an angle $\alpha$ with the sliding direction, which as mentioned above, can be between 3° and 20°, in particular between 5° and 15°. The load-bearing surface portion of the projections in this case is at least 50%, preferably 60%-80%, of the area of the sliding side.

In this case, it has also proven useful to position adjacent lines of recesses or projections so that they are offset from one another.

In a particular embodiment of the invention, in order to provide the form-fitting fixing of the sliding plates relative to the base body, securing partition walls can be provided at the end so that the sliding plate is necessarily moved along with the base body of the sliding block. Pins or other suitable fastening means can nevertheless also be provided, which on the one hand, ensure a joint movement of the sliding plate with the base body of the sliding block and on the other hand, permit a floating support perpendicular to the plane of the sliding plate or the slide way.

BRIEF DESCRIPTION OF THE DRAWINGS

The invention will be explained in greater detail below in conjunction with the drawings. In the drawings.

DETAILED DESCRIPTION OF THE PREFERRED EMBODIMENTS

In the context of describing the figures, it is assumed for example that an oil is used as the lubricant. The exemplary embodiments are not limited, however, to using oil as the lubricant. It is instead possible—as mentioned above—to use any suitable lubricant.

Figure 1:
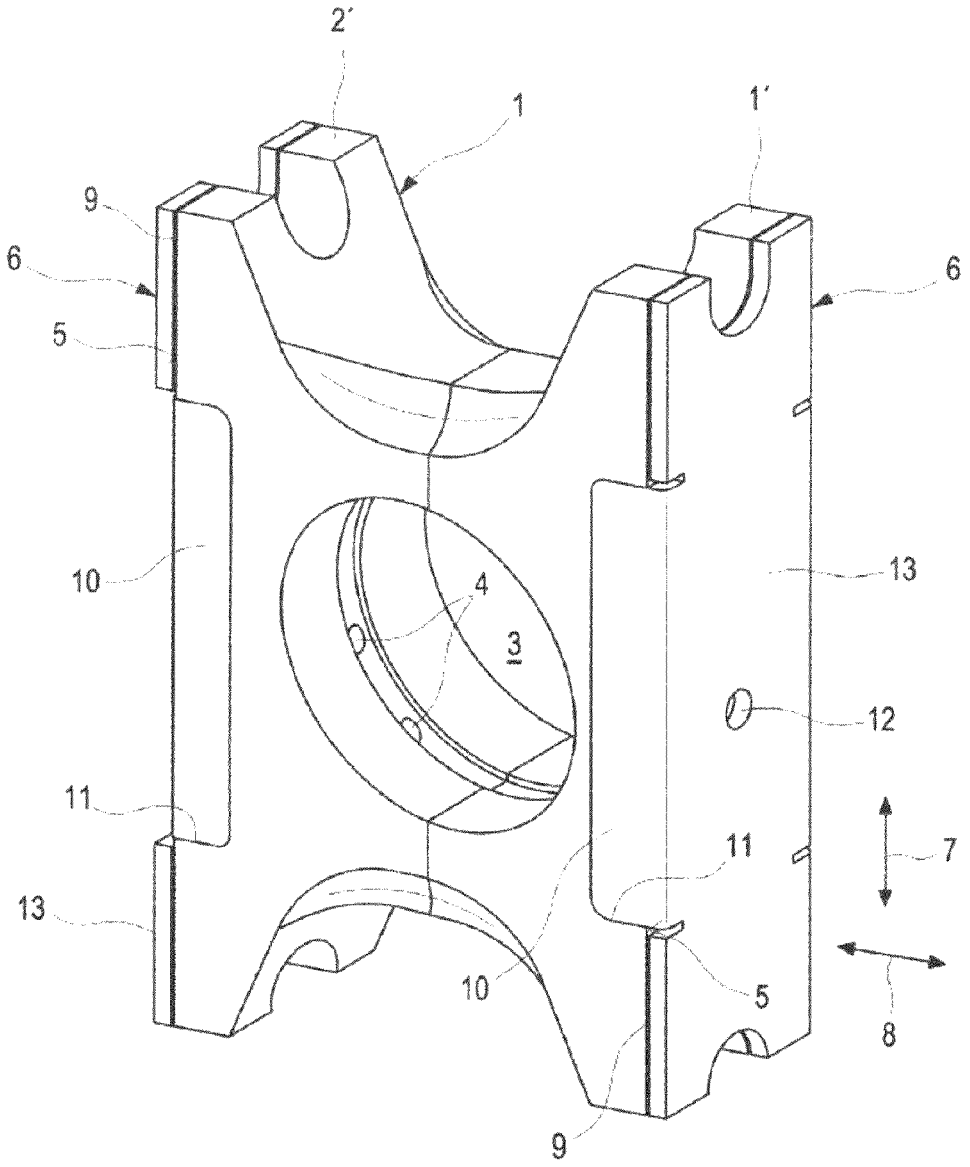
FIG. 1: shows a perspective view of a first embodiment of the sliding block according to the invention, in which a sliding plate is mounted (supported in floating fashion) on the base body of the sliding block.

A first embodiment of the sliding block according to the invention (FIG. 1) has a base body 1, which is composed of a first base body half 1' and a second base body half 2' in the exemplary embodiment. The base body 1 has a receiving opening 3 for a crankpin of a crankshaft of a scotch yoke reciprocating piston engine. Inside the receiving opening 3, at least one, preferably a plurality of conduits 4 are provided that correspond to a side surface 5, which is oriented toward a slide way (not shown) of a scotch yoke (not shown) during operation, and that emerge from this side surface. The side surfaces 5 of the base body 1 are each associated with sliding plates 6, which are connected to the base body 1 in form-fitting fashion with regard to a sliding direction 7 relative to the base body 1 and are supported in floating, i.e. movable, fashion relative to the base body 1 in a direction perpendicular to the sliding direction 7 (double arrow direction 8) in particular perpendicular to the plane of the sliding plate 6. As a result, each sliding plate 6 and the base body 1 form a first gap 9 between them. The first gap 9 serves to provide space for a first oil cushion (static oil cushion) for pressurized oil, which travels into the gap 9 via the conduits 4. In the exemplary embodiment according to FIG. 1, the gap 9 is at least partially covered by longitudinal edges of the sliding plate 6 by means of partition walls 10, which are positioned in pocket-shaped recesses 11 of the base body 1, to prevent oil from exiting laterally. The partition wall 10 or the partition walls 10 thus constitute a barrier for pressurized oil that is contained in the first gap 9. The sliding plate 6 has an oil conducting opening 12 through which pressurized oil, which is contained in the first gap 9 or which travels to a sliding side 13 of the sliding plates 6 via the conduits 4—provided that they are aligned with the oil conducting opening 12. The sliding sides 13 of the sliding plates 6 are oriented toward a slide way (not shown) of the scotch yoke (not shown) during operation of the scotch yoke reciprocating piston engine. Between the sliding sides 13 and the corresponding slide way of the scotch yoke, the relative movement between the sliding block and the scotch yoke takes place in the sliding direction 7. Consequently, between the sliding side 13 and the slide way of the scotch yoke, due to the relative speed of these two sliding partners in relation to each other, a dynamic oil film forms, which is situated in the second gap between the sliding plate 6 and the slide way of the scotch yoke.

Figure 2:
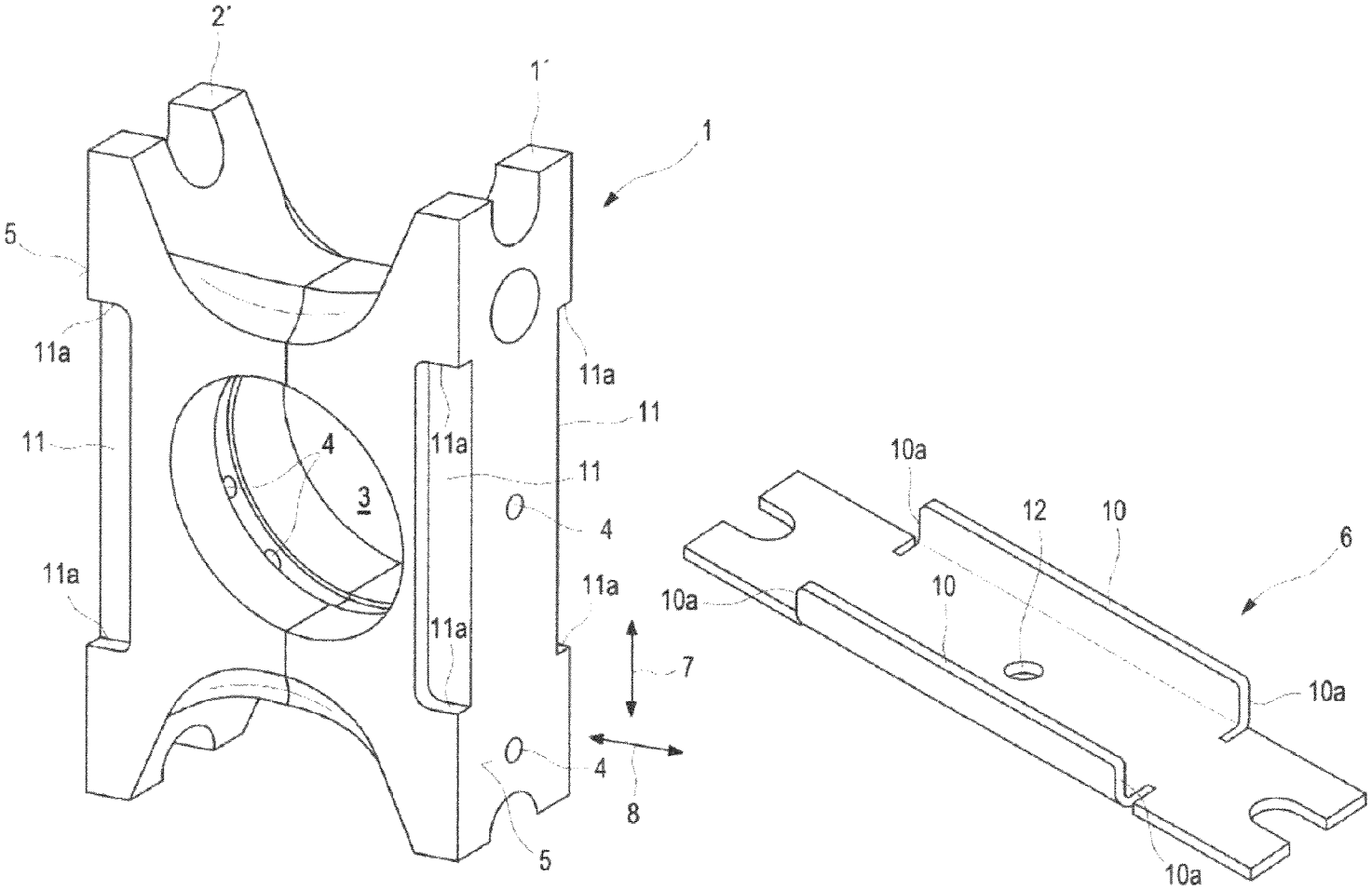
FIG. 2: shows the base body and the sliding plate of the sliding block according to FIG. 2 in the disassembled state.

In order to accommodate the partition walls 10 (FIG. 2) of the sliding plate the base body 1 has pocket-shaped recesses 11. With regard to their dimensions, the pocket-shaped recesses 11 are constructed so that the partition walls 10 rest in the pocket-shaped recesses without play or almost without play in the sliding direction 7 and by means of partition edges 10*a*, are supported on corresponding edges 11*a* of the pocket-shaped recess. In the double arrow direction 8, the partition walls 10 are guided in the pocket-shaped recesses 11 in sliding fashion so that the build-up of an oil pressure causes pressurized oil to travel through at least one conduit 4 into the gap 9 between the sliding plate 6 and the base body 1 of the sliding block.

Figure 3:
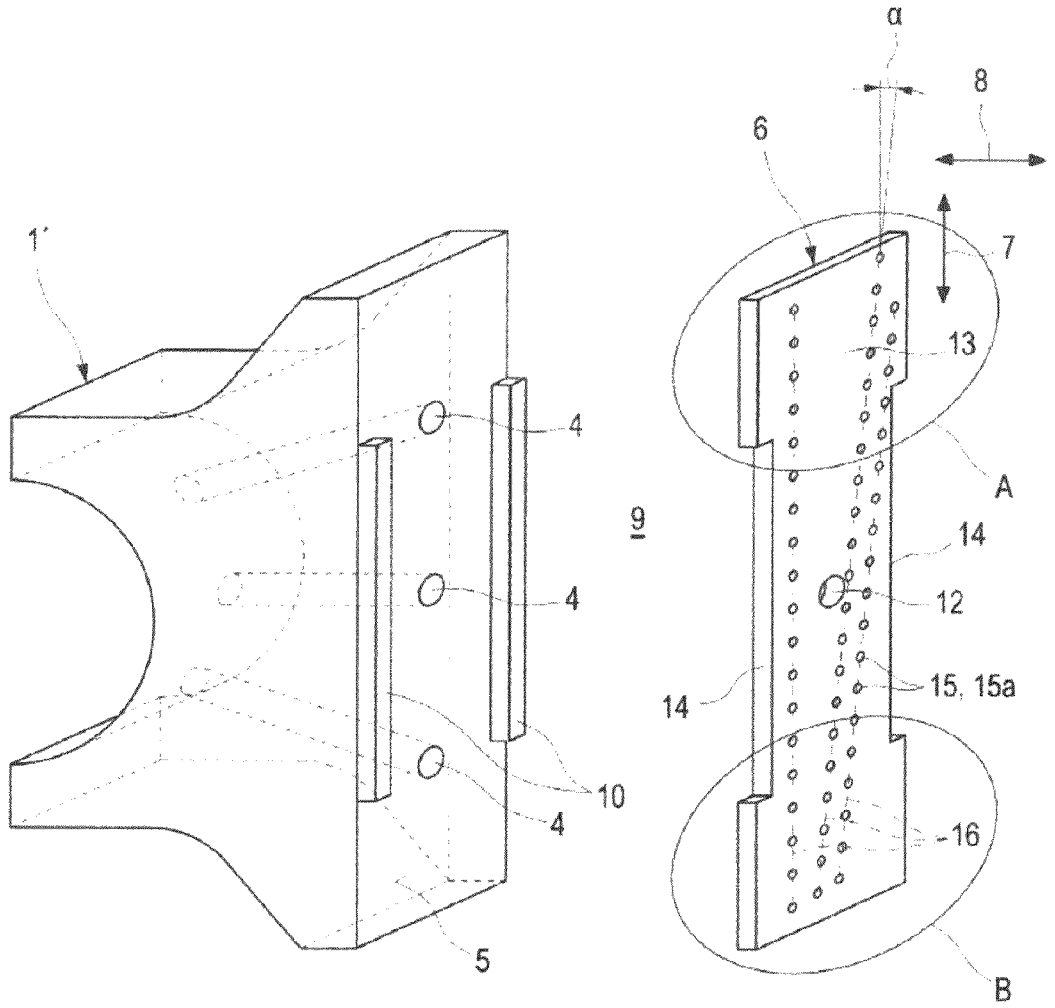
FIG. 3: shows a schematic, perspective view of a second embodiment of the sliding block according to the invention.

In another embodiment of the sliding block according to the invention shown in FIG. 3, the base body 1 has partition walls 10 that engage in corresponding recesses 14 in the sliding plate 6. In this exemplary embodiment, the partition walls 10 of the base body likewise function as barriers for an oil film or for the pressurized oil contained in the first gap 9 between the sliding plate 6 and the base body 1. As in the first exemplary embodiment, the pressurized oil travels into the gap 9 via a plurality of conduits 4. In the exemplary embodiment shown in FIG. 3, the middle conduit 4 corresponds with the oil conducting opening 12 of the sliding plate 6, thus ensuring that pressurized oil can travel into the second gap between the sliding side 13 of the sliding plate 6 and the slide way (not shown) of a scotch yoke (not shown). On the sliding side 13, which is oriented toward the scotch yoke, there are recesses 15 embodied in the form of spherical cups or projections 15 that are essentially dot-shaped, which are arranged along a line 16. The line 16 can enclose an angle $\alpha$ relative to a sliding direction 7. Two adjacent lines 7 and their projections 15 or recesses 15 advantageously have an offset a relative to each other. The angle $\alpha$ can advantageously be between 3° and 20°, in particular between 5° and 15°. This ensures that recesses/projections 15 that succeed one another in the sliding direction 7 likewise have a slight offset from one another viewed in the sliding direction 7, which improves the formation of oil pockets or oil cushions for the emergency operation. With a sufficiently large amount of play or for example with a sufficiently viscous oil, it can naturally also be sufficient for the spherical cup-shaped recesses/dot-shaped projections 15, which are arranged in a line 16, to also be arranged parallel to the sliding direction 7.

With a particular embodiment of the sliding plates 6, the sliding side has projections 15, which are arranged in rows in the sliding direction 7. Every two adjacent rows R1 and R2 are positioned offset from each other in terms of the sliding direction 7. Between the projections 15, there are recesses 15*a*; every two projections 15 are arranged aligned with and adjacent to each other in a direction 17 transverse to the sliding plates and every two projections 15 that are arranged aligned with and adjacent to one another in one of the rows R1 or R2 in the sliding direction 7 encloses a region B of the sliding side 13 of the sliding plates 6, in the center Z of which is situated the maximum recess 15*a* relative to the projections 15. In the example according to FIG. 4, the region is approximately diamond-shaped. The depth dimension between the zenith of a projection 15 and the deepest point of a recess 15*a* is 0.05 mm to 0.1 mm.

Figure 4:
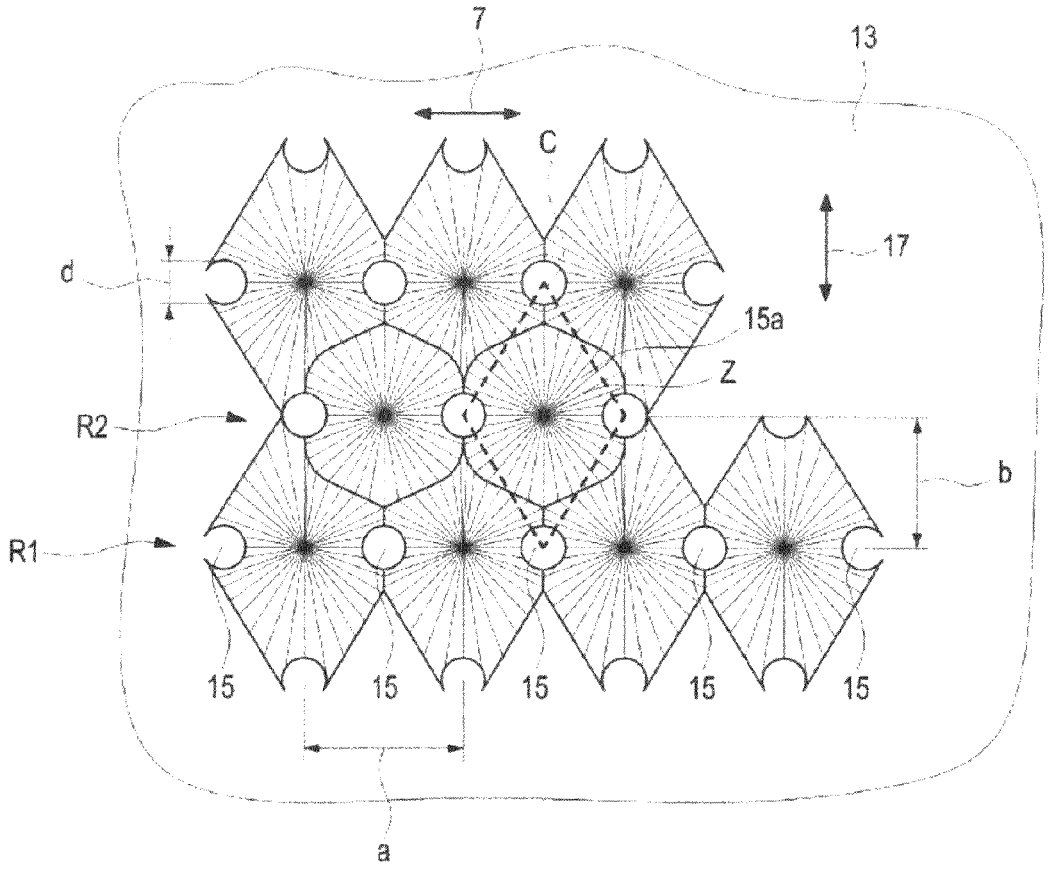
FIG. 4: shows a top view of a sliding side of a sliding plate in a schematic, enlarged view (detail).

The diameter of the projections at their highest point (d) is approximately 2 mm to 3 mm, in particular 2.5 mm. The distances A of two nubs of one row R1 or R2 are preferably approximately 2 mm. The distance B of two adjacent rows R1 and R2 to each other is preferably approximately 1.5 mm to 2.2 mm, in particular 2.0 mm. A surface structure, as shown in FIG. 4, can for example be produced by means of material-removing machining, but this is relatively costly. For larger production runs, for example in series production, the indicated dimensions and depths of the recesses can possibly be produced by stamping or another type of cold-forming. Such a surface of the sliding side of the sliding plates 6 has turned out to be particularly durable and rugged in cold-running conditions.

With the sliding block according to the invention, it is particularly advantageous that the provision of two oil cushions—i.e. a first oil cushion (static oil cushion) in the first gap 9 between the sliding plate 6 and the base body 1 of the sliding block and an oil cushion that dynamically forms between the sliding side 13 and the slide way of a scotch yoke during operation can prevent wear that is caused by tilting movements of the sliding block during operation. In particular, this relates to surface end regions of the sliding plates 6, which are schematically depicted in FIG. 3 with the capital letters A and B. This is explained here by the fact that the static oil cushion, which forms in the first gap 9, functions like a hydraulic play compensation and depending on the load, particularly depending on the load at the edges of the sliding plate 6, can yield to a certain degree so that it is possible to reliably prevent a dry friction in this region between sliding plate 6 and the scotch yoke (not shown). According to the invention, it is possible to adjust or predetermine the behavior of the oil outlet from the gap 9 during operation by providing barriers that at least partially cover the gap 9 at the circumference. Up to now it has turned out to be advantageous to forgo barriers (partition walls 10) situated at the edges in the vicinity of the wear regions A, B so that in this specific location, an oil cushion in the gap 9 can adapt relatively quickly in terms of its thickness due to tilting movements. This is possible because the partition walls 10 in these regions A and B can be entirely omitted or for example be only of a lesser height or only extend over subregions so that there are openings between the partition walls via which the oil can escape from the gap 9.

The invention claimed is:

1. A sliding block for a scotch yoke reciprocating piston engine comprising:

a base body with a receiving opening for cooperating with a crankpin of a crankshaft;

side surfaces of the base body, which are oriented toward slide ways of a scotch yoke during operation, with a supply of pressurized lubricant from the receiving opening for the crankpin to the side surfaces being provided during operation;

sliding plates connected to the base body in a region of the side surfaces in a form-fitting fashion with regard to a sliding direction relative to the base body, and the sliding plates are supported in a floating fashion relative to the base body in a direction perpendicular to the sliding direction, and between the sliding plates and the side surfaces there is a gap, which is at least partially filled with lubricant during operation of the scotch yoke reciprocating piston engine; and a barrier that encompasses the gap at least partially at edges of the gap, wherein the barrier is provided to prevent the escape of lubricant from the gap, and the barrier comprises at least one partition wall extending from either at least one of the sliding plates or from the base body, and the at least one partition wall is positioned in a pocket-shaped recess on either the base body or at least one of the sliding plates, with the at least one partition wall having a greater height than a depth of the pocket-shaped recess.

2. The sliding block according to claim 1, wherein the barrier comprises at least one partition wall on at least one of the sliding plates, which extends away from the at least one of the sliding plates toward the base body, covering the gap.

3. The sliding block according to claim 1, wherein the barrier comprises at least one partition wall on the base body, which extends away from the base body toward at least one of the sliding plates, covering the gap.

4. The sliding block according to claim 1, wherein the barrier fixes/holds at least one of the sliding plates in a form-fitting way in a sliding direction relative to the base body.

5. The sliding block according to claim 1, wherein the sliding plates are mounted so that the sliding plates are movable in a floating fashion, perpendicular to a plane of the respective sliding plate relative to the base body.

6. The sliding block according to claim 1, wherein the base body has at least one conduit, which conveys pressurized lubricant during operation and which communicates with the gap.

7. The sliding block according to claim 6, wherein the sliding plates have at least one conducting opening, through which lubricant can be conveyed to a sliding gap between the slide way of the scotch yoke and of the sliding plates during operation.

8. The sliding block according to claim 7, wherein the lubricant conducting opening is aligned with the conduit.

9. The sliding block according to claim 1, wherein a sliding side of the sliding plate that is oriented toward the scotch yoke during operation has a plurality of recesses in order to provide lubricant pockets.

10. The sliding block according to claim 9, wherein the recesses are spherical cups and have a depth of from 0.05 to 0.1 mm.

11. The sliding block according to claim 9, wherein the recesses are arranged in a linear fashion in a longitudinal direction of the sliding plate.

12. The sliding block according to claim 11, wherein lines composed of the recesses enclose an angle ($\alpha$) relative to the sliding direction, where the angle ($\alpha$) is between 3° and 20°.

13. The sliding block according to claim 1, wherein the sliding side has a plurality of nub-like projections, which are arranged in a linear fashion in the longitudinal direction of the sliding plate.

14. The sliding block according to claim 13, wherein adjacent lines of recesses or projections are positioned so that they are offset from one another.

15. The sliding block according to claim 1, wherein the barriers are partition walls that extend away from the base body, at least partially covering the gap.

16. The sliding block according to claim 1, wherein in order to provide a form-fitting fixing of the sliding plates relative to the base body, securing partition walls are provided at the ends of the plates or the base body.

17. The sliding block according to claim 2, wherein the at least one partition wall on at least one of the sliding plates engages in at least one pocket-like recess of the base body.

* * * * *